US005983885A

United States Patent [19]

Jarvi

[11] Patent Number: 5,983,885

[45] Date of Patent: Nov. 16, 1999

[54] NATURAL DRAFT AUTOMATIC FEED PELLET STOVE

[76] Inventor: Michael A. Jarvi, P.O. Box 786, Gold Bar, Wash. 98251

[21] Appl. No.: 08/784,194

[22] Filed: Jan. 15, 1997

[51] Int. Cl.[6] ..... F24B 13/04; F24B 1/18; F23K 3/00

[52] U.S. Cl. ..... 126/73; 126/500; 126/312; 126/80; 110/101 CA

[58] Field of Search ..... 126/58, 68, 77, 126/80, 312, 73, 500; 110/101 CA, 101 R, 101 C, 101 CF

[56] References Cited

U.S. PATENT DOCUMENTS

| | | | |
|---|---|---|---|
| 44,816 | 10/1864 | Parsons | 126/58 |
| 71,698 | 12/1867 | Chamberlain et al. | 126/500 |
| 101,341 | 3/1870 | Wood . | |
| 110,654 | 1/1871 | Heath . | |
| 117,053 | 7/1871 | Cushing's | 126/500 |
| 204,170 | 5/1878 | Shepard | 126/500 |
| 404,273 | 5/1989 | Gartside . | |
| 421,073 | 2/1890 | Heim . | |
| 426,393 | 4/1890 | Morrison et al. . | |
| 659,971 | 10/1900 | Hower | 126/501 |
| 689,755 | 12/1901 | Schumann | 126/73 |
| 806,323 | 12/1905 | Cowles . | |
| 1,441,531 | 1/1923 | Crolsen . | |
| 1,808,487 | 6/1931 | Ahlberg | 126/73 |
| 2,442,124 | 5/1948 | Gilmore | 126/73 |
| 2,745,397 | 5/1956 | Levin | 126/77 |
| 4,343,288 | 8/1982 | Tjosvold | 126/77 |
| 4,351,315 | 9/1982 | Babbage | 126/73 |
| 4,458,662 | 7/1984 | Barnett | 126/77 |
| 4,565,184 | 1/1986 | Collins et al. | 126/68 |
| 4,630,553 | 12/1986 | Goetzman | 126/77 |
| 4,782,765 | 11/1988 | Miller et al. | 110/186 |
| 4,823,684 | 4/1989 | Traeger et al. | 99/447 |
| 4,964,396 | 10/1990 | Crum | 126/508 |
| 4,989,521 | 2/1991 | Traeger et al. | 110/108 |
| 5,113,843 | 5/1992 | Henry et al. | 126/77 |
| 5,144,939 | 9/1992 | Christopherson | 126/73 |
| 5,243,963 | 9/1993 | Riener | 126/73 |
| 5,251,607 | 10/1993 | Trager et al. | 126/73 |
| 5,331,943 | 7/1994 | Ko | 126/73 |
| 5,357,877 | 10/1994 | Nuesmeyer et al. | 110/101 C |
| 5,429,110 | 7/1995 | Burke et al. | 126/25 |

FOREIGN PATENT DOCUMENTS

| | | |
|---|---|---|
| 355493 | 6/1922 | Germany . |
| 19406 | 10/1909 | Norway . |
| 750431 | 6/1956 | United Kingdom . |

*Primary Examiner*—Ira S. Lazarus
*Assistant Examiner*—David Lee
*Attorney, Agent, or Firm*—Todd N. Hathaway

[57] ABSTRACT

A natural draft, gravity feed pellet stove. The body of the stove is formed by a vertical section of large diameter pipe, with an air intake pipe extending from the back of the stove to below a combustion grate. Pellet fuel is discharged onto the grate through a slot at the bottom of a hopper, and the grate is sloped so that the pellets roll away from the slot and over the grate as they are combusted. The combustion gasses flow into two exhaust pipes, each having a diameter similar to that of the intake pipe so as to establish a 2:1 exhaust/intake flow ratio. Cross-drilled reburner tubes are installed across the intake ends of the exhaust pipes to provide additional air for complete combustion. The bottom plates of the storage hopper are free from attachment along their lower edges, so that these expand and contract on a continuous basis with changes in the temperature of the stove; this causes cyclical distortion of the plates which shifts the fuel downwardly towards the discharge opening.

20 Claims, 7 Drawing Sheets

84
28
68
72
126
122
124
66
92
115
64
119
114
120
106
116
60
118
62
56
58
54
82
80

NATURAL DRAFT AUTOMATIC FEED PELLET STOVE

BACKGROUND a. Field of the Invention

The present invention relates generally to fuel burning stoves, and, more particularly, to a natural draft pellet stove for heating houses and other structures.

b. Background Art

In many areas, wood burning stoves have been largely superseded by pellet stoves for heating homes, shops, and other structures. Pellet stoves combust pellet fuel, which is a compressed by-product of the forestry industry. The pellet fuel is conventionally made by grinding and processing bows, limbs, needles, leaves, and other waste products. By comparison with cord wood, the pellet fuel has the advantage of being more economical, and also much easier to handle and store owing to its comparatively fine consistency; commonly, pellet fuel is supplied in bags or is simply stored in a walled bin until use.

Although pellet fuel thus has many advantages which promote its use for home heating, it is not entirely an ideal fuel. In particular, because of their inherently high water and resin content, the pellets are notoriously difficult to keep lit, and require high combustion temperatures for proper burning. As a result, the majority of commercially available pellet stoves resort to the expediency of electric blowers to maintain combustion, and also use an electric auger to feed the pellets into the combustion area. These various electric motors, blowers, and feed mechanisms add substantially to the cost of the finished product, with the result that commercially available pellet stoves tend to be inordinately expensive, often to the point where they are unaffordable to many people in rural areas where they are most needed. Moreover, the cost of the electricity necessary for continuous running of the electric motors means that the electric bill for operating the pellet stove often exceeds what it would have cost to simply run an electric heater without any stove at all. Still further, the availability of electric service is somewhat spotty in some rural areas, and is subject to outages during periods of bad weather, rendering the stove inoperative just when heat is most needed.

Furthermore, reliance on the various electric blower and drive motors results in mechanical complexity and, therefore, lower reliability and higher maintenance costs; for example, it is not uncommon for conventional pellet stoves to suffer multiple blower and feed auger failures in a single season of continuous use. Also, even with the blowers to maintain the draft, the fire frequently dies out in convention pellet stoves, owing to the difficulty of keeping the fuel lit; when this happens, however, the feed auger typically continues to operate unabated, ending up packing the firebox full of unburned pellets, which may not only lead to substantial mechanical damage, but also necessitates a difficult and tedious cleanup operation to remove the packed fuel from the interior of the stove.

Perhaps even more seriously, the reliance on electric blowers leads to severe compromise of the thermal efficiency of conventional pellet stoves, so that many of these produce a dismal heat output for the amount of fuel which is consumed. In addition to inherently inefficient designs, this problem in part also stems from the tendency of manufacturers to use undersized/inadequate blowers and motors, both to scrimp on manufacturing and also in an effort to keep operating costs down. Still further, most conventional pellet stoves lack sufficient storage capacity to operate unattended for more than a few hours before refilling, so that they are unable to keep the dwelling warm if the owner must leave for an extended period; for example, many conventional stoves are capable of holding only about ¼ bag of pellet fuel.

Yet another problem with conventional pellet stoves is that many of these are notorious for producing excessive creosote and smoke during operation. In part, this stems again from the inability to maintain proper drafting and combustion of the fuel at sufficiently high temperatures. Creosote buildup, which results in large part from inadequate combustion temperatures, not only impairs heat transfer of the stove, but can ultimately lead to a serious fire hazard. Furthermore, the particulates and other harmful emissions in the smoke from conventional pellet stoves can be damaging to the environment, with the result that many of these stoves must now be fitted with expensive and only partially effective catalytic convertors in an effort to meet air quality regulations.

Accordingly, there exists a need for a pellet stove which is capable of maintaining efficient combustion of pellet fuel using natural draft, and without the need for electric blowers to do this. Furthermore, there is a need for such a stove which is self-feeding, and does not require an auger or other electrically driven mechanism for feeding fuel into the combustion area. Still further, there exists a need for a pellet stove which ensures complete combustion of the pellet fuel so as to minimize particulates and other harmful emissions in its exhaust gasses. Still further, there is a need for such a stove which is thermally efficient, so as to produce an optimum output of heat per amount of fuel consumed. Still further, there exists a need for such a stove which is economical to manufacture, so as to be affordable for a larger group of consumers, and one which is mechanically simple and reliable so as to minimize operating and maintenance costs.

SUMMARY OF THE INVENTION

The present invention has solved the problems cited above, and is a natural draft pellet stove which sustains continuous combustion of the pellet fuel without requiring the assistance of any electrical/mechanical blowers. Broadly, this comprises: (a) feed means having a discharge opening for discharging pellet fuel, (b) grate means to which the pellet fuel is discharged for combustion from the discharge openings, (c) air supply means for providing an upward draft of combustion air through the grate means for supporting the combustion thereon, (d) exhaust means for receiving combustion gasses from the combustion of the pellet fuel on the grate means, the exhaust means having a predetermined flow capacity which is greater than a predetermined flow capacity of the air supply means so as to effectively maintain the upward draft through the grate means, and (e) means for automatically displacing the pellet fuel over the grate means away from the discharge opening as the pellet fuel is combusted, so as to keep the opening clear for discharge of additional pellet fuel onto the grate means.

The means for displacing the pellet fuel over the grate means away from the discharge opening may comprise at least one portion of the grate means having an upper surface which extends at a predetermined downward angle from the discharge opening, so that the pellet fuel rolls away from the opening during the combustion thereof; the grate means may comprise a substantially planar screen member having a sloped upper surface which forms the surface which extends at a predetermined downward angle from the discharge opening.

The predetermined flow capacity of the exhaust means may be approximately twice the predetermined flow capacity of the air supply means. The air supply means may comprise a generally horizontal air intake pipe extending from a rearward side of the stove and having a grate means mounted at a forward end thereof, so that the combustion air flows upwardly from the air intake pipe through the screen member so as to support combustion thereon.

The exhaust means may comprise first and second exhaust pipes, each exhaust pipe having an intake end positioned above and generally approximate to the screen member so that the combustion gasses generated by the combustion on the screen member flow along substantially direct paths into the intake openings, each exhaust pipe having a diameter approximately equal to a diameter of the air intake pipe. The first and second exhaust pipes may extend outwardly from their intake ends in opposite directions from one another, and the exhaust pipes may extend along an axis generally perpendicular to an axis of the air intake pipe, with the intake ends thereof being positioned substantially equidistant from the screen member at the forward end of the air intake pipe, so that the combustion gasses are substantially equally received by the exhaust pipes.

The exhaust means may further comprise first and second riser pipes mounted to the exhaust pipes so as to receive the combustion gasses therefrom, the riser pipes being connected to the exhaust pipes by elbow portions which force a flow of the combustion gasses to make a sharp directional change therein, so as to slow the flow of combustion gasses and increase the stay time thereof in the riser pipes. Each of the riser pipes preferably extends upwardly and rearwardly at a predetermined angle to vertical, so that the flow of combustion gasses therethrough maintains a rate which is selected for optimum extraction of heat therefrom as the gasses pass through the riser pipes; the predetermined angle at which the riser pipes extend may be about 40° above horizontal.

The exhaust means may further comprise at least one reburner tube mounted across the intake opening of each exhaust pipe, the reburner tube having a bore for drawing in warm air from outside the exhaust pipe and at least one cross-orifice for discharging the warm air into the flow of combustion gasses in the exhaust pipe. The reburner tube may comprise a tubular member having a central bore for drawing in the warm air and a plurality of cross-drilled bores for forming the orifices for discharging the air into the flow of combustion gasses. Preferably, there are a plurality of the reburner tubes mounted across the intake opening of each exhaust pipe.

The feed means may further comprise hopper means for storing a charge of the pellet fuel, and automatic gravity feed means for feeding the fuel in the hopper means downwardly to the discharge opening. The automatic gravity feed means may comprise at least one plate member mounted in the hopper means so as to be in contact with the pellet fuel therein. The plate member may comprise a plate member forming a directional surface sloping downwardly toward the discharge opening, and upper edge of the plate member being fixedly mounted to a framework of the stove and a lower edge being free from attachment to the framework, so that the plate member is free to distort as the member certainly expands and contracts with the changes in temperature of the stove, so as to shift the pellet fuel in the hopper means downwardly towards the discharge opening. Preferably, the at least one plate member comprises a plurality of the plate members mounted in the hopper means so as to form a downwardly sloped chute area directed towards the discharge opening, with the upper edges of the plate members being fixedly mounted to the framework of the stove and the lower ends of the plate members being free from attachment at the lower end of the chute area, adjacent the discharge opening.

In one embodiment, the main body of the stove is formed of large diameter steel pipe, the upper part of which forms a hopper for holding several bags of pellet fuel and is closed by a hinged lid. Sloping walls feed the pellets under gravity through a small opening at the bottom of the hopper which regulates the discharge onto a stainless steel burner grate. Air is supplied from beneath the grate, through a long horizontal pipe which extends from the back of the stove and has an automatic or manual damper installed in its intake end.

DETAILED DESCRIPTION

Figure 1:
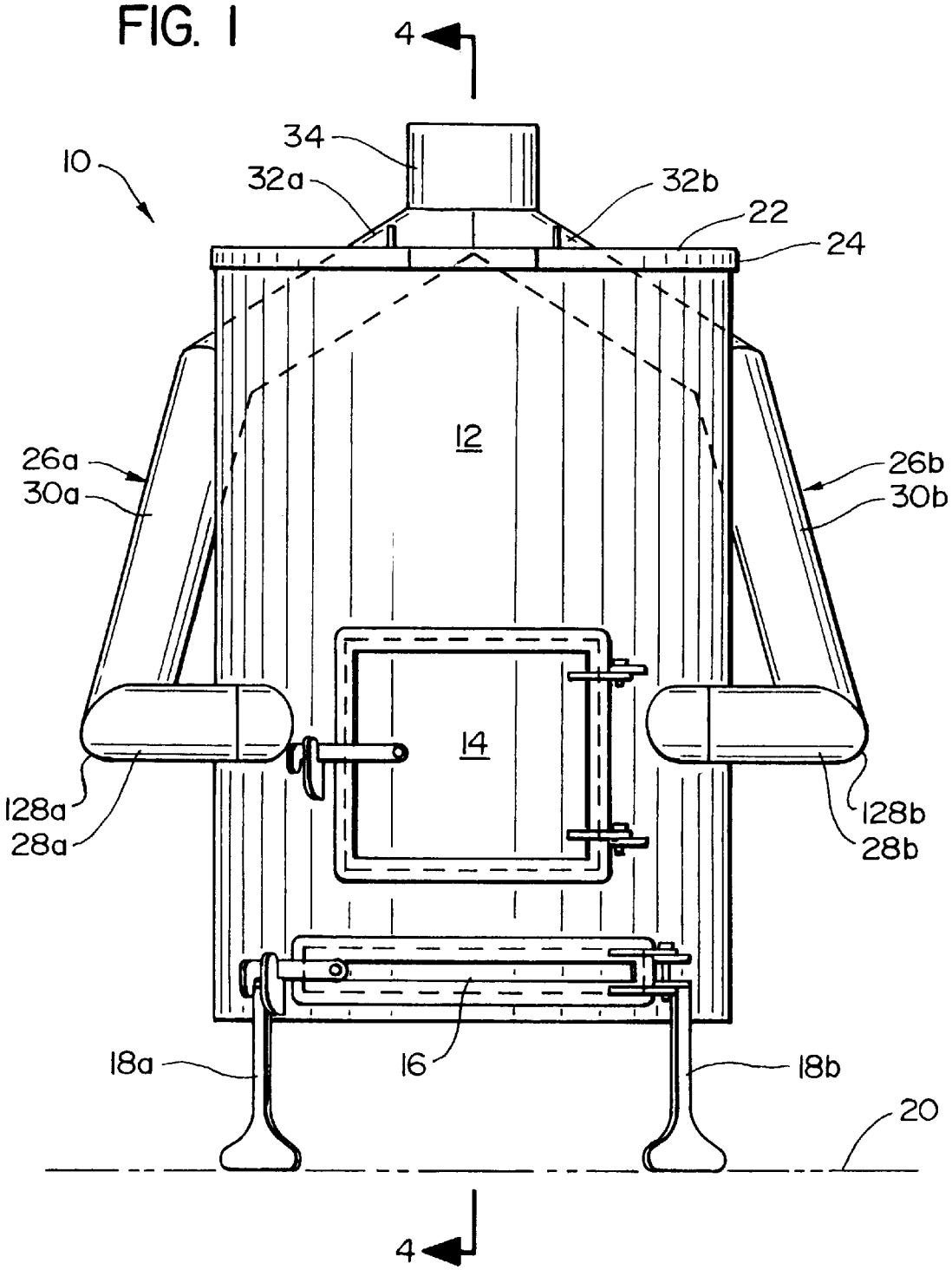
FIG. 1 is a front elevational view of a natural draft pellet stove in accordance with the present invention, showing the firebox and ash pan access doors, and the dual external smoke pipes which receive the combustion gasses from the firebox.

FIG. 1 shows a natural draft pellet stove 10 in accordance with the present invention. As can be seen, this includes a large diameter, upright cylindrical body shell 12, which is, for example, suitably formed of a 36" length of 24" diameter, ¼" wall steel pipe. A firebox access door 14 is provided at the front of the stove, using a cutout portion of the cylindrical steel body, and similarly there is an ash pan access door 16 below this which opens into the ash collection area below the firebox. A plurality of leg members 18 are welded or otherwise mounted around the bottom of the body portion 12, for supporting the stove a spaced distance above the floor surface 20. As with the majority of the other components of the stove, the leg members are suitably constructed of welded steel plate in the interest of economy and durability. The upper part of the body portion, in turn, houses a storage bin for holding a comparatively large supply of the pellet fuel. Access to this is provided by hinged circular lid member 22 having an annular lip 24 which fits over the upper edge of the stove body.

First and second smoke pipes 26*a*, 26*b* extend outwardly from the cylindrical body portion of the stove on either side of the firebox, with the intake pipes 28*a*, 28*b* thereof extending generally horizontally and parallel to the frontal plane of the assembly, although these may be angled slightly (e.g., 10°) rearwardly or forwardly in some embodiments. By positioning both the firebox and the exhaust pipes at the front of the stove assembly, the present invention has the advantage of projecting the heat forwardly into the room, where it is most needed, rather than back towards a wall behind the stove, where additional insulation would ordinarily be required for fire protection (as is common with conventional wood/pellet stoves).

Figure 2:
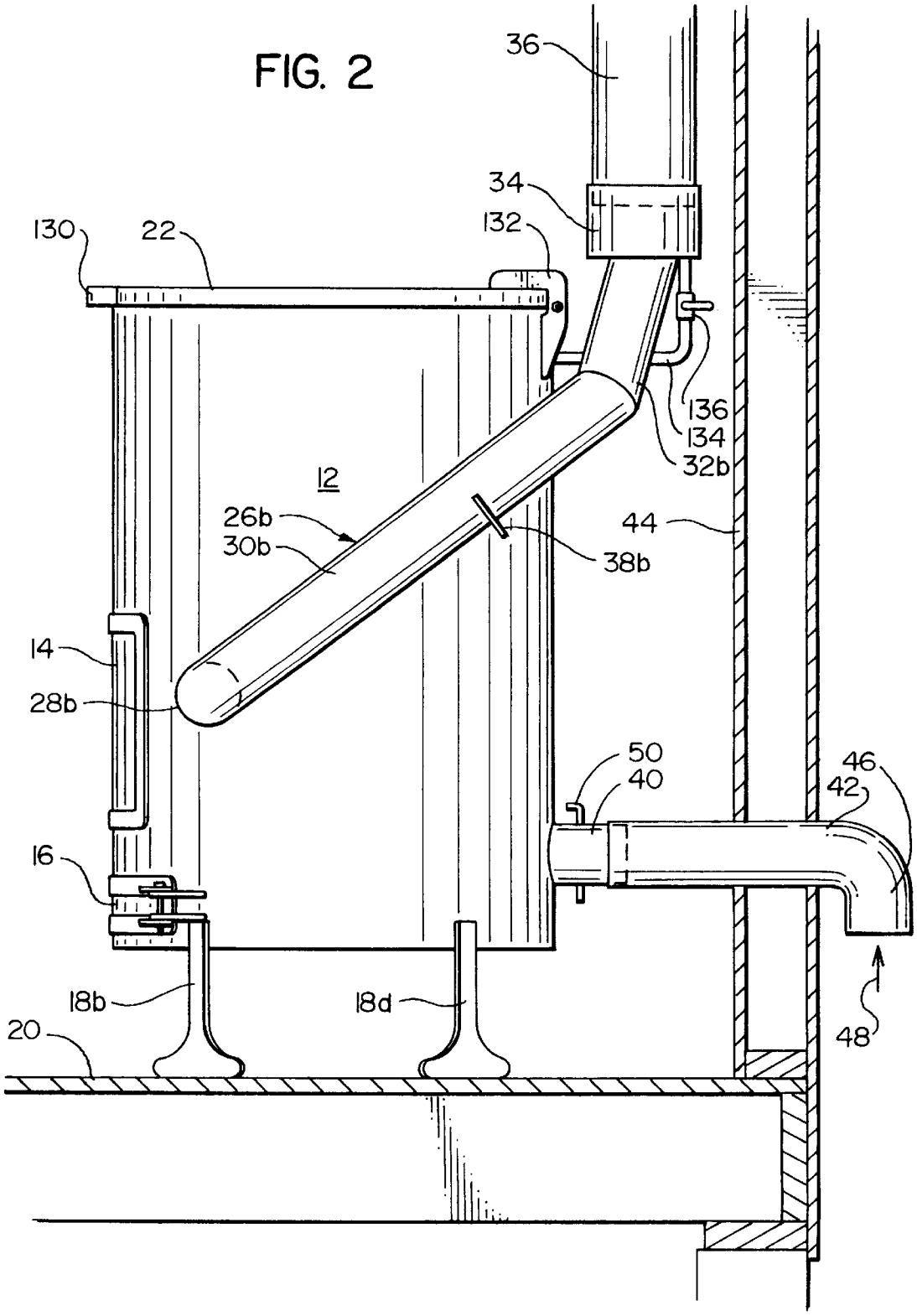
FIG. 2 is a side elevational view of the pellet stove of FIG. 1, showing the air intake pipe which extends rearwardly from the rear of the stove, for providing a flow of combustion air to the firebox, this having a diameter approximately equal to that of each of the two smoke pipes which receive the exhaust gasses.
Figure 3:
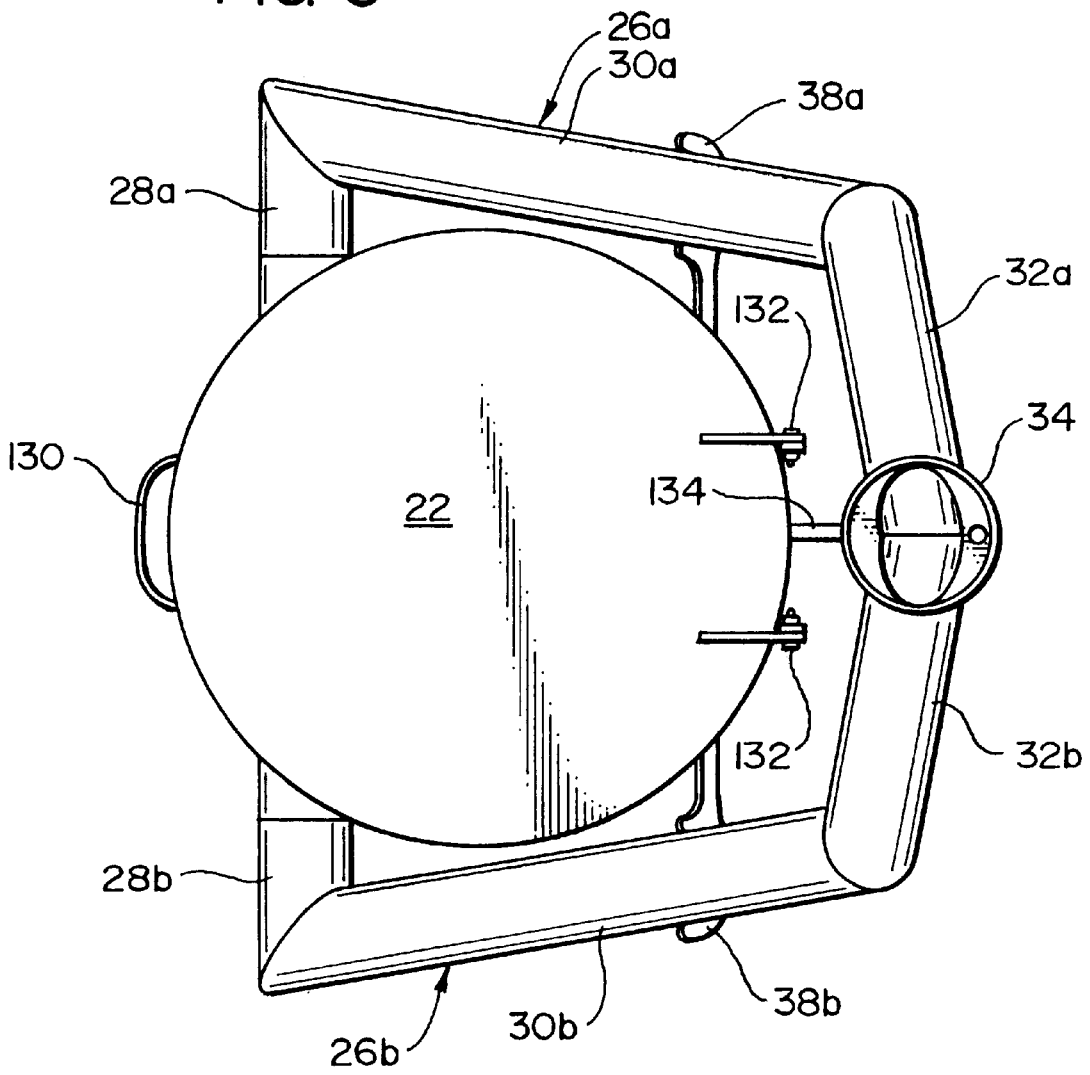
FIG. 3 is a top plan view of the natural draft pellet stove of FIGS. 1–2, showing the top lid for the internal storage hopper for the pellet fuel, and the manner in which the dual smoke pipes are joined at a collector pipe at the rearward side of the stove for discharge into a single chimney opening.

As will be described in greater detail below, the exhaust pipes are joined at a comparatively sharp angle to upwardly and rearwardly angled riser pipes 30*a*, 30*b*, which in turn lead into upwardly and inwardly angled Y-pipes 32*a*, 32*b*. These feed into a common collector pipe 34 which is configured to be attached to a single stove pipe 36 leading out of the structure. As can be seen in FIG. 2, each of the riser pipes 30 is supported about two-thirds of the way up along its length by an hanger bracket 38 which is welded to the side of the body portion 12 of the stove; rather than being hard mounted to the pipe, the hanger has a hook or saddle portion in which the pipe rests, forming a sliding fit which allows for expansion/contraction as the stove heats and cools.

As can also be seen in FIG. 2, the horizontal air intake or draft pipe 40 of the assembly extends forwardly from the back of the body portion of the stove, perpendicular to the long axis of the exhaust intake pipes; fairly precise alignment is important in this regard, to ensure that the flow is not directionally biased towards one exhaust pipe or the other. The outer end of the draft pipe is mounted in fluid communication with an air intake duct 42 which extends through a wall 44 of the structure and has a downturned outer end 46 through which exterior air is drawn, in the direction indicated by arrow 48; this serves to exclude rain water and also gusts of wind which might cause a "ram" effect or otherwise disrupt the flow of combustion gasses in the stove. A damper 50 is also installed in draft pipe 40, to control the flow of combustion air therethrough and thereby regulate the rate of operation of the stove; operation of the damper may be manual, using a protruding handle as shown, or a thermostatic control may be fitted for automatic operation.

Figure 4:
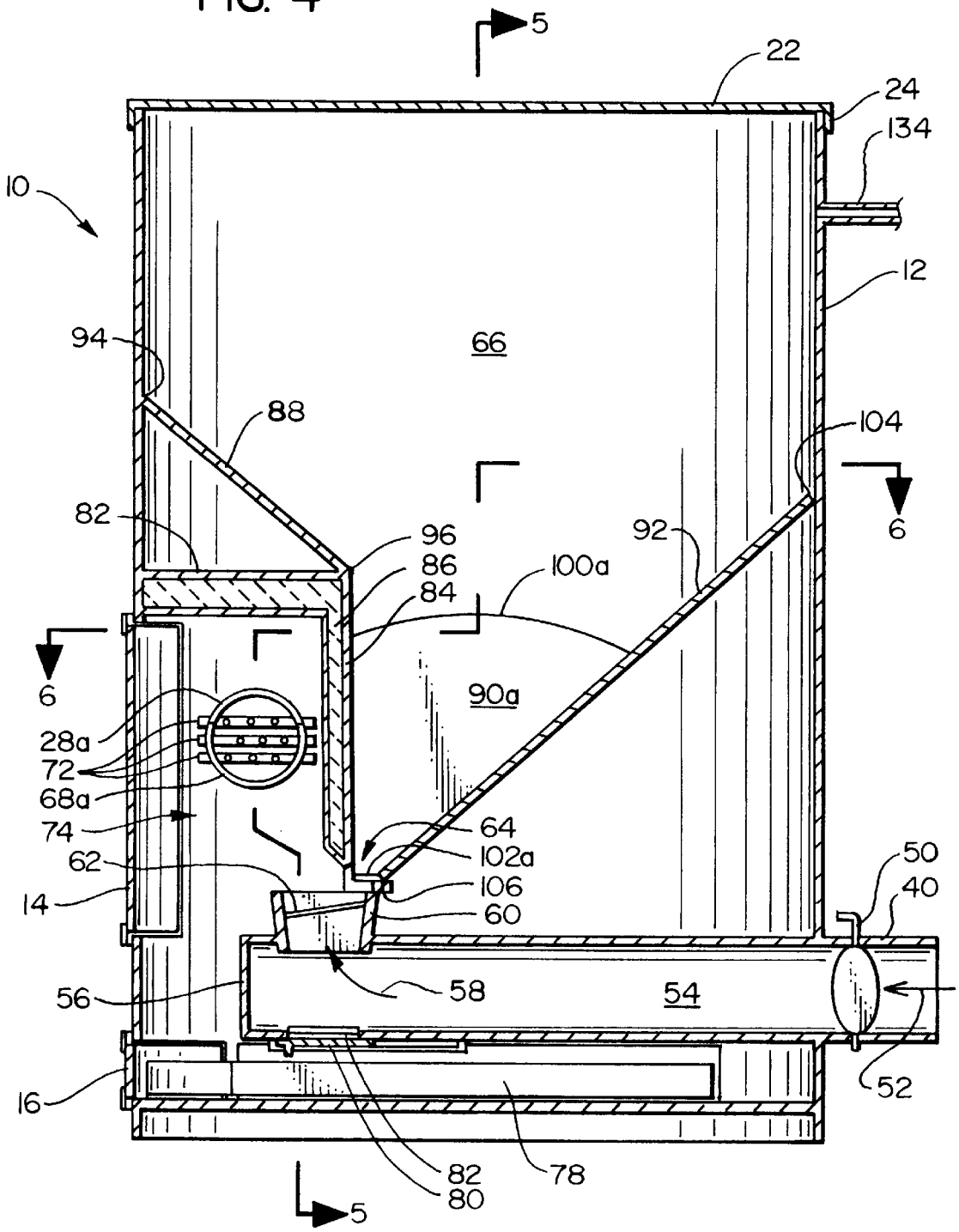
FIG. 4 is a side elevational view of a cross-section taken vertically through the pellet stove of FIGS. 1–3, along line 4—4 in FIG. 1, this showing the relationship of the air intake pipe to the combustion zone, and the chute at the bottom of the pellet hopper for gravity feed of the pellets onto the combustion grate.
Figure 5:
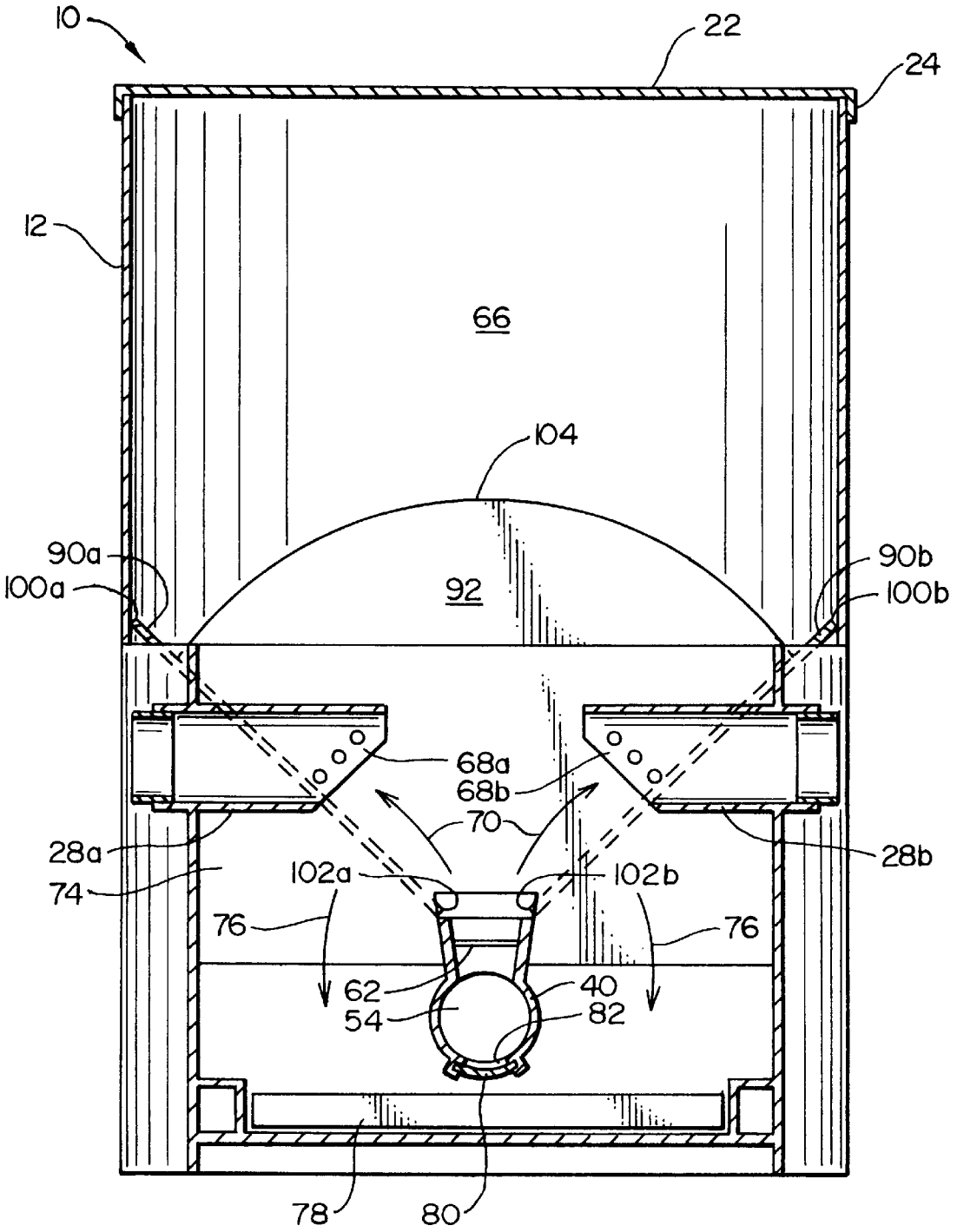
FIG. 5 is a front elevational view of a vertical cross-section taken vertically through the pellet stove of FIGS. 1–4, along line 5—5 in FIG. 4, showing the positioning of the intake ends of the two smoke pipes, above and on each side of the combustion grate at the forward end of the air intake pipe.
Figure 6:
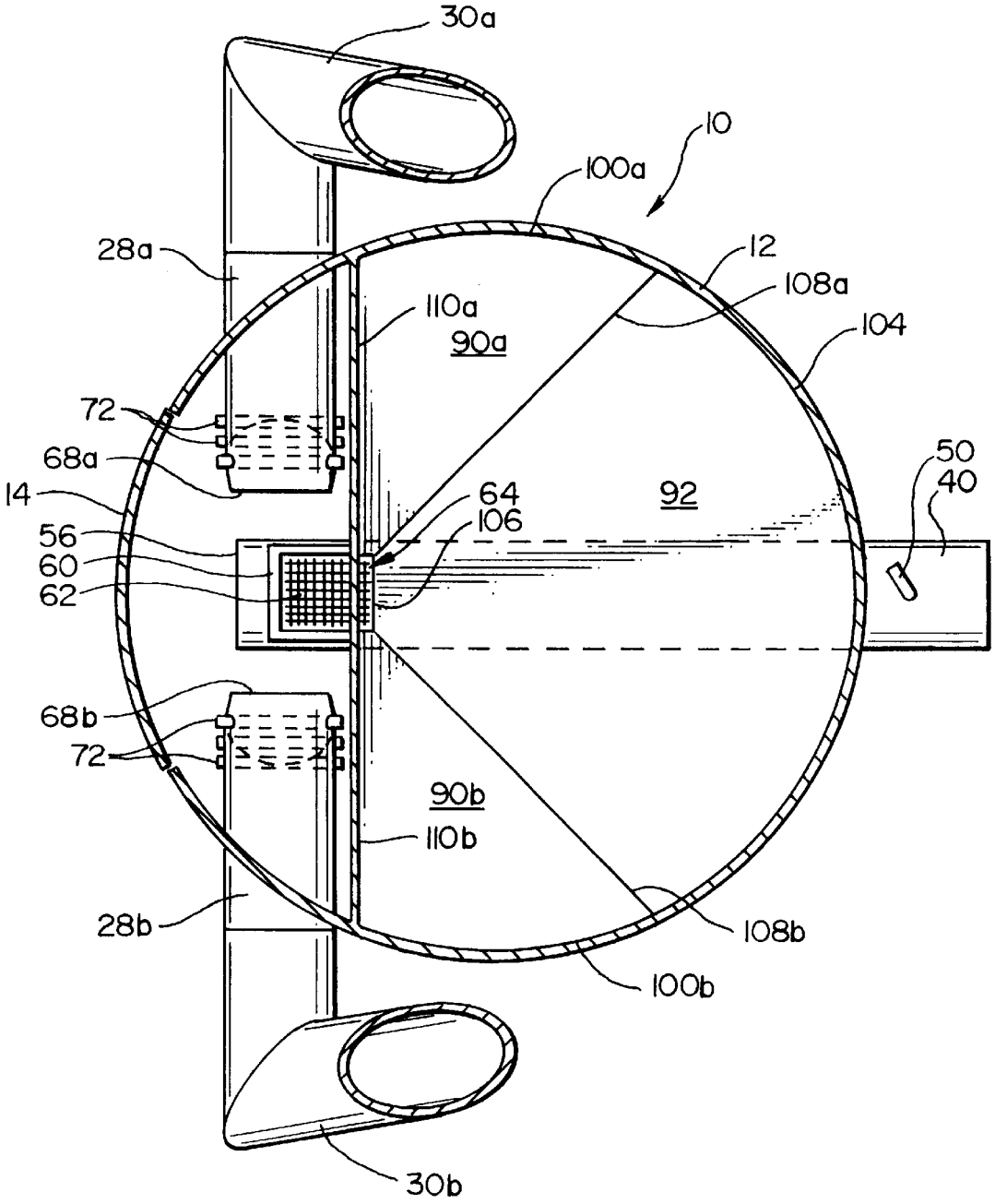
FIG. 6 is a top plan view of a cross-section taken horizontally through the pellet stove of FIGS. 1—5, along staggered line 6—6 in FIG. 4, the combustion area at the forward end of the air intake tube and the intake ends of the two smoke pipes adjacent to this.

The cross-sectional views of FIGS. 4, 5 and 6 show the principal components within the interior of the stove. As can be seen, the air entering the rearward end of the draft pipe 40 passes by the damper 50, in the direction shown indicated by arrow 52, and then flows through the interior 54 of the tube towards it forward end, which is closed in the axial direction by an end plate 56. A cutout is formed in the upper side of the supply pipe adjacent its closed forward end, however, and a flue box 60 is mounted in this to form an upwardly extending passage through which the combustion air is directed, as indicated by arrow 58.

The draft pipe 40 provides a confined flow path for the combustion air, leading directly from the exterior air source to the underside of the combustion grate, this path being sized to have a maximum flow capacity about equal to that which is required to support combustion on the grate at the designed maximum rate of operation of the stove. This provides a concentrated, comparatively high speed flow of combustion air which is directed immediately into the combustion zone. This is to be contrasted with the arrangement in most conventional pellet stoves, in which the combustion air is simply supplied through an opening in the casing, and is then drawn from the interior of the stove into the combustion zone, in a manner similar to an open grate in a fireplace. This conventional approach leads to inherently poor drafting and low combustion temperatures, resulting in many of the problems discussed above. In the present invention, by contrast, the directed flow of combustion air, combined with the comparatively straight, short flow paths from the combustion grate to the exhaust intake openings, leads to strong drafting and high temperature, complete combustion of the pellet fuel.

A rectangular piece of screen is mounted at an angle across the upper end of the flue box 60, so as to form a sloping grate 62 onto which pellet fuel is fed from the discharge slot 64 of the hopper 66. The grate 62 is preferably formed of ¼" mesh stainless steel, which provides superior heat transfer so that the screen remains continuously hot despite the inflow of cool air, and therefore supports more complete combustion and reduced buildup of deposits on the grate, and this material also exhibits a high melting temperature and excellent resistance to erosion.

Initial combustion takes place on the screen grate 62, and the combustion gasses flow upwardly and outwardly from this into the intake ends 68*a*, 68*b* of the exhaust pipes 28*a*, 28*b*, in the directions indicated by arrows 70 in FIG. 5. The location of the intake ends of the exhaust pipes immediately above and on either side of the combustion grate provides direct, unobstructed flow paths through the firebox. This helps to create and maintain a strong upward draft through the combusting fuel, yet also permits a degree of separation of ash and other comparatively large particulate matter from the gas flow before it enters the exhaust pipes. As will be described in greater detail below, the ash and heaviest particulate matter drops into an ash collection pan, while lighter, suspended particulate matter reenters the flow of combustion gasses through the reburner tubes so as to ensure complete combustion of the particulates before they pass out the chimney. For example, the intake ends of the exhaust pipes may suitably be positioned about 1-½–2-½" above the level of the combustion grate, and about 2–3" on either side of the centerline. Also, as can be seen, the intake ends of the exhaust pipes are cut so as to be angled towards the direction of flow of the combustion gasses, to provide a more efficient flow path.

Final combustion of the gasses takes place within the smoke pipes themselves. Each of the two smoke pipes 26 has a diameter approximately equal to the diameter of the draft pipe 40 (suitably 3-½" diameter), so that there is an approximately 2:1 ratio between exhaust capacity and supply air; this relationship is also important in establishing and maintaining the strong draft through the grate 62 which sustains combustion of the pellet fuel without requiring any form of mechanical or electrical blower. Also a series of the reburner tubes 72 are mounted across the intake end of each exhaust intake pipe 28, which (as will be described in greater detail below) serve to draw heated air and suspended particulates from the interior of the firebox and discharge these into the flow of combustion gasses.

The bulk of the ash resulting from the combustion is blown off of the grate 62 and upwardly in the direction of arrows 70 in FIG. 5, and then falls downwardly in the direction indicated by arrows 76 into a shallow ash collection pan 78 at the bottom of the firebox. If any ash or heavy impurities in the fuel (e.g., pieces of gravel, metal, etc.) fall downwardly through the grate 32 and collect in the forward end of the draft pipe 40, these can be removed by periodically sliding back the cover plate 80 of a cleanout opening 82 cut in the bottom of the draft tube, in the area below the flue box, so that the particulate materials drop into the collection pan. The pan 78 itself is removed through the access door 16 at the front of the stove for periodic dumping.

The back and rear sides of the firebox 74 are provided with double walls 82, 84 filled with refractory brick (suitably, 1-¼" thick) or sand 86 to provide insulation between the combustion area and the fuel in hopper 66. It will also be seen in FIGS. 4 and 5 that the bottom of the fuel hopper 66 is formed of a series of pie-slice shaped plates 88, 90*a*, 90*b*, and 92, that slope inwardly and downwardly to form a chute area leading towards the discharge slot 64 at their bottom junction. Only the forward one of these plates (front plate 88 ) is fixedly mounted (e.g., welded) at both its upper and lower edges 94, 96 to the body portion 12 of the stove assembly. The upper edges 100*a*, 100*b* of the side plates 90*a*, 90*b*, and the upper edge 104 of the rear plate 92, are also fixedly mounted to the inside of the shell, in a manner resembling a welded ring, and the plates themselves are attached along their welded edges 108*a*, 108*b* and 110*a*, 110*b*. The lower edges 102*a*, 102*b* and 106 of these members, however, are not welded in place, but instead are left unattached so that the plates are able to deform as they expand and retract with heating and cooling of the stove. Thus, as the charge of fuel on the grate combusts, the increase in heat causes the plates to expand, and then when the combustion dies down to an extent the plates contact, resulting in cyclical deformation of the plates which serves to shift the pellets in the hopper downwardly so that these are fed evenly towards and through the discharge slot 64. This in turn obviates any need for a feed auger or other electrical/mechanical drive system for transporting pellet fuel into the combustion area.

Figure 7:
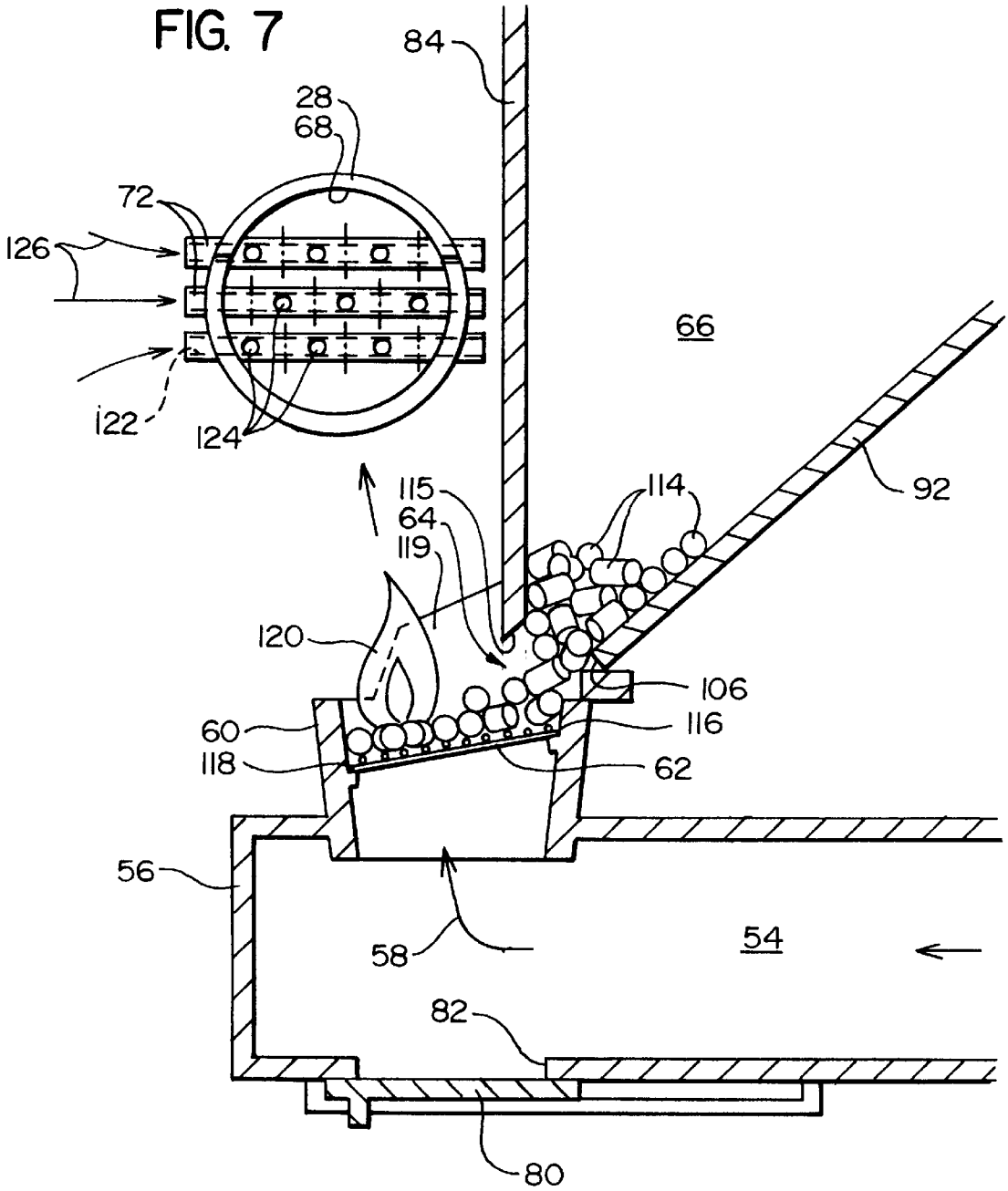
FIG. 7 is a side elevational view of a cross-section taken vertically through the combustion grate at the forward end of the air intake tube, showing the manner in which combustion air enters from below this and supports combustion of pellet fuel which is discharged onto the grate from the feed chute, and the manner in which the hot combustion gasses flow upwardly and outwardly into the two exhaust pipes.

FIG. 7 shows the relation of the components in and operation of the combustion zone in greater detail. As can be seen, the pellets 114 are discharged through the slot 64 at the bottom of the hopper 66, onto the upper edge of the grate 62; a bevelled upper edge 115 of the slot 64 facilitates smooth feeding of the pellets through the opening. The grate 62 slopes downwardly from its rearward edge 116 to its forward edge 118, at an angle of about 2° in the embodiment which is illustrated; for example, the screen may be approximately 2" by 3" long, with a drop of about ½" from back to front.

Thus, as the pellets 114 hit the rearward edge of the grate 62, they tumble forwardly down this toward the front edge 118, with combustion taking place as the pellets roll over the flat, even surface provided by the screen; first and second wing walls 119 retain the rolling pellets and prevent them from spilling off the edges of the combustion area. The slope of the screen is selected to provide a rate of roll such that, once the stove is operating, the pellets will be substantially fully consumed by the time they reach the front edge of the grate; for example, using 5/16" pellet fuel, and a ¼ inch mesh, 2" by 3" stainless steel grate having the 20° slope noted above, about 5–10 seconds is required for each pellet to roll from back to front over the grate, and this time is sufficient for substantially complete combustion to take place by the time it approaches the forward edge 118. As was noted above, the ash which remains at this point is simply blown off of the grate by the air draft, and settles through the firebox into the ash collection pan. Since the pellets are thus constantly rolling away from the hopper discharge slot 64 while they are being combusted, this, in combination with the gravity feed provided by the shifting movement of the side and rear hopper plates, obviates any possibility of the fuel building up at or blocking the discharge slot; conversely, only as much fuel will be discharged onto the grate as is consumed, so that the pellet feed will not fill the firebox in the event the fire goes out. For use with 5/16" pellet fuel, the discharge slot 64 may suitably have the form of a quadrilateral cutout 3" long on the top edge and 2" on the bottom edge, with 1-½" long downwardly and inwardly angled side edges.

As was noted above, after initial combustion takes place on the sloping grate 62, as indicated at 120 in FIG. 7, the partially combusted gasses flow upwardly and outwardly into the intake ends 68 of the smoke intake pipes 28, and several (e.g., three) reburn tubes 72 are arranged in a row across the open end of each pipe. The reburn tubes 72 are installed in a series of holes drilled horizontally through the pipes 28, so that the first and second ends of the tubes project outwardly from the sides of the pipe. The internal bores 122 of the reburn tubes are thus in communication with the air in the firebox around the tube, but from outside the direct flow of gasses between the burner grate and the exhaust pipes. A series of cross-drilled holes 124 extend outwardly from the longitudinal bore, and are in fluid communication with the hot gasses flowing through the exhaust intake pipe 28. The flow of the gasses creates a suction which draws heated air and suspended particulates from within the firebox, inwardly through the open ends of the tubes in the direction indicated by arrows 126, and then outwardly through holes 124 into the flow of combusting gasses within the exhaust pipe. When using 3-½" diameter exhaust tubing and three reburn tubes per intake, the bore in the reburn tubes is suitably about ⅜" with six 11/32" diameter cross-drilled holes at 90-degree alternating axes.

The heated air has circulated through the interior of the firebox prior to being drawn in at the ends of the reburner tubes, so that the bulk of the ash and particulate material suspended therein has dropped out into the ash collection pan 78. Those small particulates which remain suspended are then drawn in with the heated air through the protruding ends of the reburner tubes 72. Due to the elevated temperature of the reburner tubes, and also the relatively higher oxygen content of the heated air entering the flow of combustion gasses, the suspended particulates are subjected to secondary combustion as they are discharged through the orifices 122, this being visible as "flaring" which extends from the orifices when the stove is in operation. This recombustion greatly reduces the level of particulate matter in the exhaust flow, to the point where the need for a separate catalytic converter or filtration system in order to meet regulatory requirements is eliminated. Moreover, the uptake and recombustion of the fine particulate material prevents its accumulation within the interior of the firebox, reducing the need for periodic cleaning.

The flow of combustion air and gases is quite strong in the vicinity of the combustion grate, which ensures continuous and effective combustion. However, as is shown in FIG. 1, the exhaust flow through the intake pipes 28 is initially in a horizontal direction, and then there is an abrupt change of direction at the sharply-angled (roughly 90°) elbows 128*a*, 128*b* where the intake pipes are joined to the riser pipes. This arrangement serves to slow the exhaust flow to a desired degree, in order to ensure that the residence time of the gasses in the exhaust pipes will be sufficient that there will be substantially complete combustion, and also that there will be maximum extraction of heat from the gasses before they flow out the chimney 36.

From the horizontal exhaust intake pipes and the elbows 128 the hot exhaust gasses enter the riser pipes 30*a*, 30*b*, which extend upwardly and rearwardly at an angle preferably in the range from about 30 °–45° above vertical, with an angle of about 40° being eminently suitable in the embodiment which is illustrated. This gradual rise, as opposed to a directly vertical one, maintains the desired rate of flow of the gasses through the exhaust pipes, again to ensure that the heat is completely extracted and conducted/radiated to the air in the surrounding room through the steel pipes.

Optimally, the exhaust gasses retain very little residual heat when they enter the collector pipe 34 and are removed via chimney 36, so that energy loss is minimal. For example, in a prototype stove constructed in accordance with the embodiment illustrated in FIGS. 1–7, the exterior temperature of the exhaust pipes while under full operation was found to be in the range of 200–3000° F. at elbows 128*a*, 128*b*, but the collector 34 and upper ends of the Y-pipes 32*a*, 32*b* were cool to the touch. For safety purposes, the hot portions of the pipes may be covered by expanded metal or screening (not shown), if desired. Moreover, the comparatively high combustion temperatures generated at the grate and in the lower ends of the exhaust pipes ensure complete combustion of the pellet fuel without generating significant amounts of creosote; as a result, despite the cool temperatures at their in their upper reaches, only a light soot accumulates in the exhaust and riser pipes during operation, and this is easily removed using a brush and vacuum cleaner.

As was also noted above, the upper end of the hopper 66 is closed by a lid 22, a handle 130 and hinges 132 being provided so that this can be lifted periodically to replenish the supply of fuel. When this is done, the excess draft provided by the 2:1 intake-to-exhaust flow ratio ensures that the flow of air will be downwardly through the pile of fuel in the hopper and into the firebox, so as to prevent any entry of flame and/or smoke upwardly into the fuel through the discharge slot 64. Moreover, the downward flow of air through slot 64 disrupts the upward flow of combustion air through the grate, in the direction indicated by arrow 58, so that combustion of the pellet fuel cannot be sustained for an extended period; this ensures that the fire will die out if the lid is accidentally left open for an extended period, for safety reasons.

A hopper having the dimensions of the exemplary embodiment which is shown herein stores sufficient pellet fuel (approximately 40 pounds) for the stove to burn continuously for up to a maximum of four to six days between recharging, depending on the temperature of operation. To prevent any steam and/or odors which may have been driven off of the mass of fuel by the heat from being drawn into the room as the lid is pulled open, a small suction line 134 may be mounted between an upper portion of the hopper and the collector pipe 34, so that a ball valve 136 in the line can be opened to draw off any steam or noxious vapors just before the lid is opened. Once the lid is closed, the ball valve should be closed again to avoid any possibility of smoke or flame being drawn upwardly through feed slot 64.

Exemplary dimensions for the embodiment of the present invention which has been shown and described herein are set forth in the following table. It will be understood, however that these dimensions may vary depending on the overall size of the stove, with larger/smaller models being provided for the greater/lesser heat output, or for greater or lesser fuel storage capacity, as desired. For example, a smaller model having a one-bag hopper capacity can be constructed using a body portion formed of a 28" length of 20"- diameter, ¼"-wall steel pipe.

| | |
|---|---|
| Body Diameter | 24" |
| Body Height | 36" |
| Thickness | ¼" |
| Left and Right Exhaust Holes | 4" dia, 12" above base |
| Firebox Access Door | 11-¾" W × 11" H, 7" above base |
| Ash Door | 16" W × 2" H, bottom 1" above base of stove |
| Draft Tube | 3-½" dia. by ¼" wall pipe, 24" long, top edge 7" above base of stove |
| Exhaust Pipes (all) | 3-½" × ½" wall pipe |
| Exhaust Intake Pipes | 7" long |
| Exhaust Riser Pipes | 23" long |
| Exhaust Y-Pipes | 20" long |
| Burner Box | 3" × 2" at top, 2" high, tapering downwardly to 2-¾" × 2-½" base (in draft tube) |
| Pellet Feed Slot | 3" upper edge, 2" lower edge, 1-½ angled side edges |
| Hopper Back Plate | Top Edge 22", Bottom Edge 3-½", side edges 16". |
| Hopper Side Plates | Upper Edge 9-½", Bottom Edge 2", Side Edges 14-¾" |
| Lid | 23-¾" dia., 1" lip |
| Fire Brick | 2700° |

Although the present invention has been described herein with reference to an exemplary embodiment in which the body portion of the stove is formed by an upright piece of large-diameter steel pipe, which has the advantages of strength, durability, and economy of manufacture, it is to be understood that the stove of the present invention may be provided with a framework having other shapes, or may be constructed of other suitable materials, as desired. Accordingly, it is to be recognized that these and various other alterations, modifications, and/or additions may be introduced into the constructions and arrangements of parts described above without departing from the spirit or ambit of the present invention as defined by the appended claims.

What is claimed is:

1. A natural draft pellet stove comprising:

an upright body portion;

a storage hopper formed in an upper end of said body portion for holding a supply of pellet fuel;

a discharge opening formed at a lower end of said storage hopper;

a plurality of sloping plate members mounted in a lower end of said hopper so as to form a chute area for directing said pellet fuel through said discharge opening, each said plate member having an upper edge which is fixedly mounted to said body portion of said stove and a lower edge adjacent said discharge opening which is free from attachment to said body portion so that each said plate member is free to distort as said plate member alternately expands and retracts with changes in temperature of said stove, so that said alternating distortion shifts said pellet fuel downwardly through said chute area towards said discharge opening;

a combustion grate mounted adjacent to and below said discharge opening for receiving pellet fuel which is discharged therethrough, said combustion grate having a screen surface which slopes away from said discharge opening so that said pellet fuel rolls away from said opening as said fuel is combusted thereon;

a generally horizontal air supply pipe having an intake end at a rearward side of said body portion of said stove and extending forwardly therethrough to a forward end at said combustion grate, for providing an upwardly directed flow of combustion air through said sloped screen surface of said combustion grate;

first and second exhaust pipes having intake openings positioned above and proximate to said combustion grate for receiving a flow of combustion gasses resulting from combustion of said pellet fuel on said screen surface, each said exhaust pipe having a diameter approximately equal to a diameter of said air supply pipe so that said exhaust pipes have a total flow capacity equal to approximately twice a flow capacity of said air supply pipe so as to maintain an upward draft through said combustion grate, said exhaust pipes extending generally perpendicular to said air intake pipe and having intake openings which are positioned above and proximate to said combustion grate and spaced about equidistant therefrom so as to form substantially direct flow paths from said combustion grate and so as to receive approximately equal portions of the flow of combustion gasses therefrom;

a plurality of reburner tubes mounted across said intake opening of each said exhaust pipe, each said reburner tube having a longitudinal bore for drawing in heated air and suspended particulates from outside of said exhaust pipe and a plurality of cross-drilled openings for discharging said heated air and suspended particulates into said flow of combustion gasses for complete combustion thereof in said exhaust pipes; and first and second riser pipes mounted to said exhaust pipes for receiving said flow of combustion gasses therefrom, said riser pipes being mounted at an approximately right angle corner to said exhaust pipes and extending upwardly at an intermediate angle between horizontal and vertical so as to slow said flow of combustion gasses and increase a stay time of said gasses in said riser pipes, so as to maximize extraction of heat therefrom while maintaining an upward flow of said gasses therethrough.

2. A natural draft pellet stove, comprising;

a firebox having an open interior;

feed means having a discharge opening for discharging pellet fuel;

grate means onto which said pellet fuel is discharged for initial combustion from said discharge opening of said feed means;

air supply means for providing an upward draft of combustion air through said grate means for supporting said combustion thereon;

at least one exhaust pipe for receiving combustion gasses from said initial combustion of said pellet fuel on said grate means, said exhaust pipe having an intake end which is positioned above and closely proximate said grate means so that combustion gasses generated by a said initial combustion pass from said grate means to said intake end of said exhaust pipe along a substantially direct, unobstructed flow path through a portion of said open interior of said firebox, said exhaust pipe having a predetermined flow capacity which is sufficiently greater than a predetermined flow capacity of said air supply means to maintain said upward draft through said grate means at a rate which is sufficiently high that said gasses pass through said firebox before complete combustion and undergo final combustion in said exhaust pipe, and that ashes produced by said initial combustion of said fuel are blown upwardly off of said grate means and fall out of said flow path between said grate means and said exhaust pipe into said open interior of said firebox; and means for automatically displacing said pellet fuel over said grate means away from said discharge opening as said pellet fuel is combusted and said ash is blown upwardly off said grate means, so as to keep said opening clear for discharge of additional pellet fuel onto said grate means.

3. The natural draft pellet stove of claim 2, wherein said means for displacing said pellet fuel over said grate means away from said discharge opening comprises:

at least one portion of said grate means having an upper surface which extends at a predetermined downward angle from said discharge opening, so that said pellet fuel rolls away from said opening during said combustion thereof.

4. The natural draft pellet stove of claim 3, wherein said grate means comprises:

a substantially planar screen member having a sloped upper surface which forms said surface which extends at said predetermined downward angle from said discharge opening.

5. The natural draft pellet stove of claim 4, wherein said predetermined flow capacity of said exhaust pipe is approximately twice said predetermined flow capacity of said air supply means.

6. The natural draft stove of claim 5, wherein said air supply means comprises:

a generally horizontal air intake pipe extending from a rearward side of said stove and having said grate means mounted at a forward end thereof so that said combustion air flows upwardly from said air intake pipe through said screen member so as to support said combustion thereon.

7. The natural draft pellet stove of claim 6, wherein said at least one exhaust pipe comprises:

first and second exhaust pipes, each said exhaust pipe having an intake end positioned above and generally proximate to said screen member so that combustion gasses generated by said combustion on said screen member flow along substantially direct paths into said intake openings, each said exhaust pipe having a diameter approximately equal to a diameter of said air intake pipe.

8. The natural draft pellet stove of claim 7, wherein said first and second exhaust pipes extend outwardly from said intake ends in opposite directions from one another.

9. The natural draft pellet stove of claim 8, wherein said exhaust pipes each extend along an axis generally perpendicular to an axis of said air intake pipe, and said intake ends thereof are positioned substantially equidistant from said screen member at said forward end of said air intake pipe, so that said combustion gasses are substantially equally received by said exhaust pipes.

10. The natural draft pellet stove of claim 9, wherein said exhaust means further comprises:

first and second riser pipes mounted to said exhaust pipes so as to receive said combustion gasses therefrom, said riser pipes being connected to said exhaust pipes by elbow portions which force a flow of said combustion gasses to make a sharp directional change therein, so as to slow said flow of combustion gasses and increase the stay time thereof in said riser pipes.

11. The natural draft pellet stove of claim 10, wherein each of said riser pipes extends upwardly and rearwardly at a predetermined angle to vertical, so that said flow of combustion gasses therethrough maintains a rate which is selected for optimum extraction of heat therefrom as said gasses pass through said riser pipes.

12. The natural draft pellet stove of claim 11, wherein said predetermined angle at which said riser pipes extend is about 40° above horizontal.

13. The natural draft pellet stove of claim 2, wherein said at least one exhaust pipe further comprises:

at least one reburner tube mounted across said intake opening of each said exhaust pipe, said reburner tube having a bore for drawing in heated air from said open interior of said firebox and at least one cross orifice for discharging said heated air into said flow of combustion gasses in said exhaust pipe.

14. The natural draft pellet stove of claim 13, wherein said reburner tube comprises:

a tubular member having a central bore for drawing in said heated air from said interior of said firebox and a plurality of cross-drilled bores forming said orifices for discharging said heated air into said flow of combustion gasses.

15. The natural draft pellet stove of claim 14, wherein there are a plurality of said reburner tubes mounted across said intake opening of said at least one exhaust pipe.

16. The natural draft pellet stove of claim 2, wherein said feed means further comprises:

hopper means for storing a charge of said pellet fuel; and automatic gravity feed means for feeding said fuel in said hopper means downwardly to said discharge opening.

17. The natural draft pellet stove of claim 16, wherein said automatic gravity feed means comprises:

at least one plate member mounted in said hopper means so as to be in contact with said pellet fuel therein.

18. The natural draft pellet stove of claim 17, wherein said plate member comprises:

a plate member forming a directional surface sloping downwardly toward said discharge opening, an upper edge of said plate member being fixedly mounted to a framework of said stove and a lower edge being free from attachment to said framework so that said plate member is free to distort as said plate member alternately expands and contracts with said changes in temperature of said stove so as to shift said pellet fuel in said hopper means downwardly towards said discharge opening.

19. The natural draft pellet stove of claim 18, wherein said at least one plate member comprises:

a plurality of said plate members mounted in said hopper means so as to form a downwardly sloped chute area directed towards said discharge opening.

20. The natural draft pellet stove of claim 19, wherein said upper edges of said plate members are fixedly mounted to said framework of said stove and said lower ends of said plate members are free from attachment at a lower end of said chute area adjacent said discharge opening.

* * * * *